US005136962A

United States Patent [19]

Palmer, Jr. et al.

[11] Patent Number: 5,136,962

[45] Date of Patent: Aug. 11, 1992

[54] AQUATIC VESSELS

[76] Inventors: John M. Palmer, Jr.; John M. Palmer, III, both of P.O. Box 115, Lutz, Fla. 33549

[21] Appl. No.: 697,191

[22] Filed: May 8, 1991

[51] Int. Cl.[5] ..... B63B 7/08

[52] U.S. Cl. ..... 114/345; 24/573.7; 441/40

[58] Field of Search ..... 441/37, 38, 40; 114/345; 156/580; 24/573.7

[56] References Cited

U.S. PATENT DOCUMENTS 3,426,397 2/1969 Redden ..... 24/573.7
4,723,502 2/1988 Sayama ..... 114/345

FOREIGN PATENT DOCUMENTS 969796 8/1958 Fed. Rep. of Germany ..... 114/345
2736789 2/1978 Fed. Rep. of Germany ..... 441/40
214065 6/1941 Switzerland ..... 24/573.7

*Primary Examiner*—Sherman Basinger

[57] ABSTRACT

The inflatable bladder (50) contained hull (30) of an aquatic vessel (20) that can be used on a floating swimming pool or spa, a raft or boat, a containment boom or the like. Connectors (33) and retaining lines (34) interconnect the free ends of hull components (31) and accessories (40). The system may be disassembled, turned inside out, and/or upside down and reassembled if desired.

2 Claims, 2 Drawing Sheets

FIG. 1
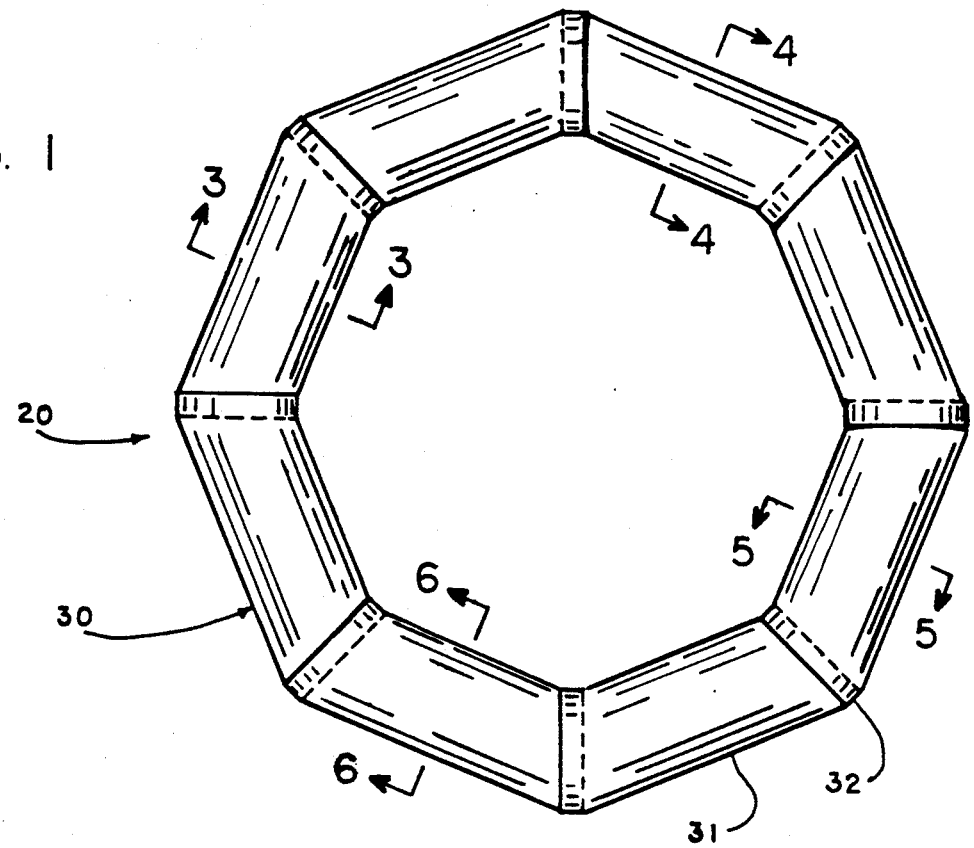
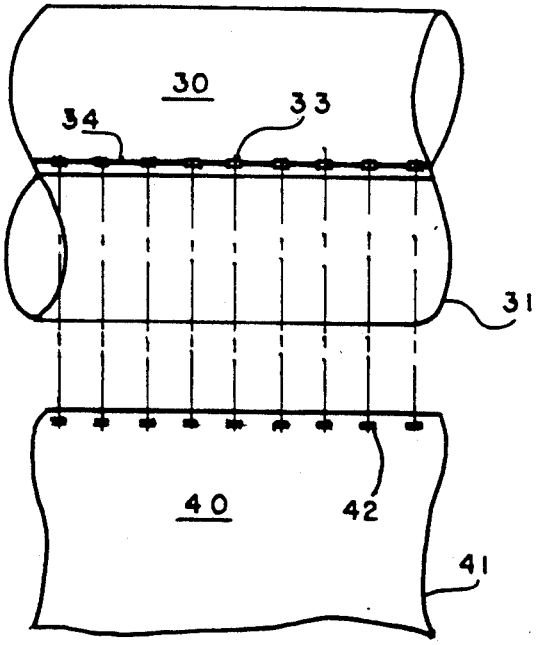
FIG. 2A
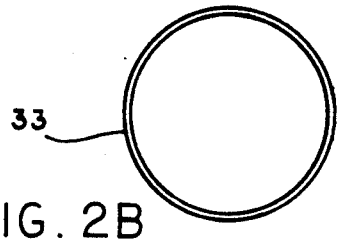
FIG. 2B
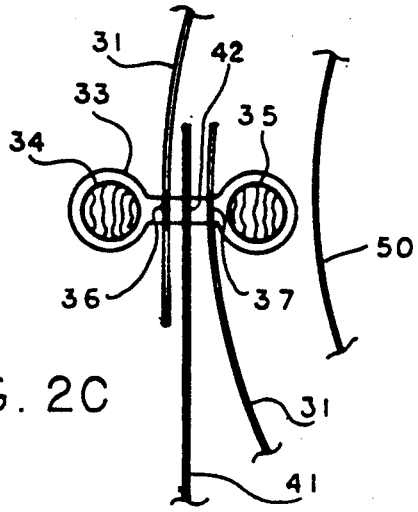
FIG. 2C

AQUATIC VESSELS

TECHNICAL FIELD

This invention relates to aquatic vessels, such as inflatable tubes, rafts, boats, floating swimming pools, floating spas, floating containment booms and the like.

BACKGROUND OF THE INVENTION

Generally recognized as advantageous for such use are inflatable hull containing gas impervious bladders, and except for plain tubes interconnecting flexible bottoms, sidewalls, roof structure or other accessories.

The connection of the hull to the other parts has been of concern to other inventors, as in Harding U.S. Pat. No. 4,744,326 for a "Self-Bailing Inflatable Boat", Palmer U.S. Pat. No. 4,087,870 for a "Floating Pool Assembly" or Palmer U.S. application No. 376,830 for a "Recreational Aquatic Vessel". Another objective is long life of the vessel by making various parts replaceable and reversible. In many respects inflatable vessels are structurally superior to rigid ones, though conventional fastening means and methods for them are generally less developed than for rigid structures. My invention emphasizes the benefits of inflatables and the importance of dependable, rugged, long life construction.

SUMMARY OF THE INVENTION

In general, the objects of the present invention are attained, in an aquatic vessel, by inflatable hull means, the final closure of said hull means accomplished with connectors, generally hoop shaped, with lines thru said connectors, incorporated into the construction of the hull means. Accessories may attach to the hull means with the same or similar connector means. A primary object of the present invention is to provide rugged aquatic vessels, with parts such as the hull means, bottom means, sidewall means, roof means, and accessories capable of being reversed or replaced as desired.

Another object of this invention is improved interconnecting of hull means to accessory means of such aquatic vessels.

A further object of the invention is economical and practical accomplishment of the foregoing and related objects.

Other objects of the present invention, together with means and methods for attaining the various objects, will be apparent from the following description and the accompanying diagrams of preferred embodiments, which are presented by way of example rather than limitation.

SUMMARY OF THE DRAWINGS

FIG. 1 is a plan view of an aquatic vessel of this invention;

FIG. 2A is a elevation view of a section of an inflated hull;

FIG. 2B is an end view of a hoop shaped connector; and

FIG. 2C is a sectional elevation view thru a hull connector assembly.

DESCRIPTION OF THE INVENTION

Figure 3:
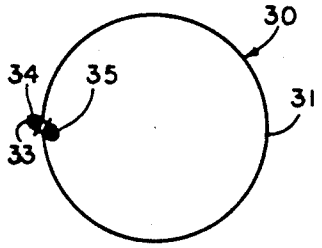
FIG. 3 is a sectional elevation view of a hull without sidewall or bottom accessories.

FIG. 1 shows in top plan aquatic vessel 20 of this invention featuring inflatable hull means 30 formed by sealing components 31 at their overlapping edges 32.

FIG. 2A shows in exploded elevation hull 30 component 31 ends connected together with connectors 33 and line 34; and sidewall accessory 40 component 41 aligned so that apertures 42 may be interconnected with connectors 33 in hull 30 above.

FIG. 2B shows an end view of connector 33. The connector may be fabricated of a variety of materials but must be flexible enough to pass thru apertures 36, 37, and 42 as shown in other figs.

FIG. 2C shows in enlarged detail a section view thru the connector assembly. The ends of component 31 are mated so that apertures 36 and 37 are properly aligned; if optional accessory 41 is to be attached aperture 42 is also aligned with apertures 36 and 37; connector 33 is inserted thru apertures 36, 37 and 42; lines 34 and 35 are threaded thru a plurality of connectors 33 as shown in this FIG. and FIG. 2A. Bladder 50, fabricated of proven material such as polyvinyl or polyurethane film, is placed inside hull 30 to provide an air tight chamber.

FIG. 3 shows hull 30 in sectional view 3—3 of FIG. 1. This embodiment could represent a plain tube such as that used on a waterslide or at the beach. As bladder 50, not shown in FIGS. 3, 4, 5 and 6 for clarity, is inflated the ends of component 31 separate causing connector 33 to be stressed thus locking lines 34 and 35 in place.

Figure 4:
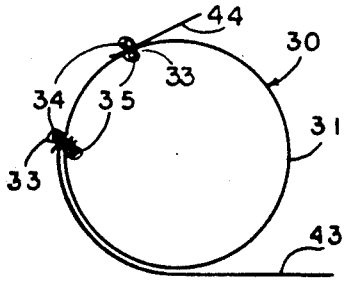
FIG. 4 is a sectional elevation view of a hull with a bottom accessory such as that used on a raft or boat.

FIG. 4 shows hull 30 in sectional view 4—4 of FIG. 1. This embodiment could represent an inflatable boat or raft. Bottom accessory 43 interconnects with the connector assembly 33, 34 and 35. The point of attachment of accessory 40 does not necessarily have to locate at the ends of component 31. The ends of component 31 may locate at any point on hull 30, not necessarily at the side or bottom as illustrated in FIGS. 2C–6. Different points of attachment may be created by punching apertures at a different location in component 31 as shown by the attachment of canopy or roof accessory 44.

Figure 5:
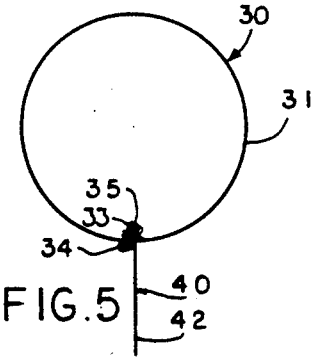
FIG. 5 is a sectional elevation view of a hull with a sidewall accessory such as that used on a floating spa, swimming pool, or containment boom, attached to the bottom of said hull.

FIG. 5 shows hull 30 in sectional view 5—5 of FIG. 1. This embodiment could represent an inflatable floating swimming pool or an inflatable containment boom. The ends of component 31 are located at the bottom of the hull and accessory 40 interconnects at that location.

Figure 6:
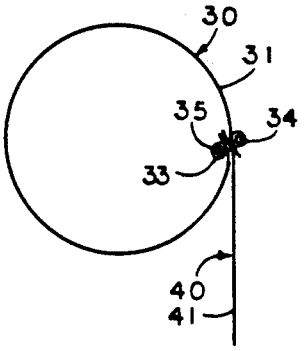
FIG. 6 is a similar sectional elevation view of a hull with a sidewall accessory attached to the side of said hull.

FIG. 6 shows hull 30 in sectional view 6–6 of FIG. 1. This embodiment could represent an inflatable floating swimming pool having the sidewall accessory 40 attach above the bottom of the hull or waterline.

Figure 7:
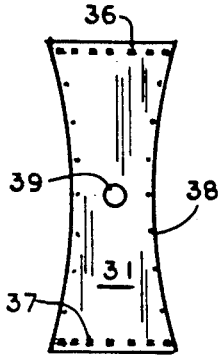
FIG. 7 is a flat layout of a hull component useful therein.

FIG. 7 shows the layout of component 31 with apertures 36 and 37 at the ends and registration apertures 38 on each side. Opening 39 receives bladder 50 fill valve.

Figure 8:
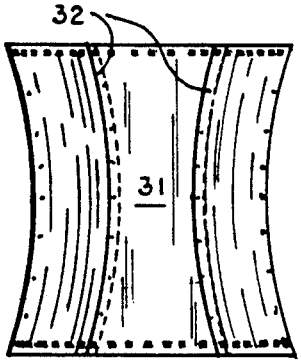
FIG. 8 is a flat layout of three hull components of the previous view sealed together.

FIG. 8 shows fragmentarily the layout of component pieces 31 from which hull 30 is assembled by sealing them overlapping 32 edgewise side-by-side and later juxtaposing their free end edges containing apertures 36 and 37 into the previously shown tubular configuration. The end edges of such components are joined together with connector assembly 33, 34 and 35.

Figure 9:
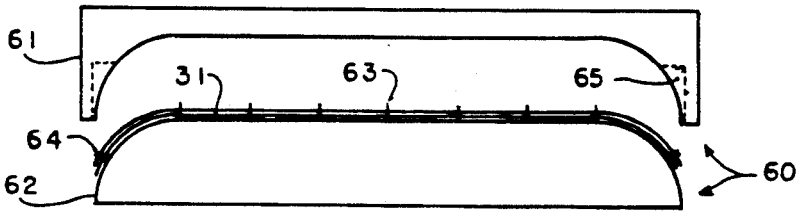
FIG. 9 is an elevation view of tools useful in sealing hull components together.

FIG. 9 shows in an elevation view tooling 60 useful in sealing components 31 together. Lower die 62 contains registration pins 63 over which component 31 registration apertures 38 are placed. Component end apertures 36 and 37 are placed over lower die pegs 64. Upper die 61 contains cavity 65 to provide clearance of peg 64 when lowered to seal the components.

Figure 10:
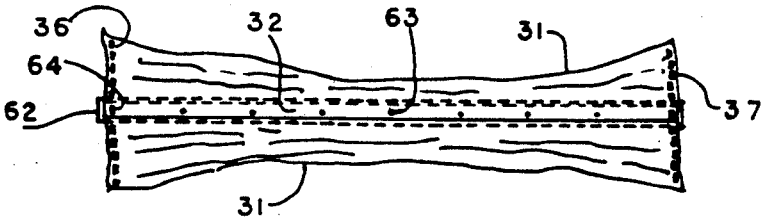
FIG. 10 is a plan view of hull components placed on the sealing tools of the previous view.

FIG. 10 shows in plan view components 31 placed on lower die 62. Since the apertures 38 are not in a straight line prior to placing on die 62 it is necessary to machine as required curves, sine waves, flats or other shapes to allow the components edges containing the apertures to rest on the die without wrinkles.

Advantages of this invention have been mentioned. Any of the hulls shown in the FIGS. could be disassembled, turned inside out and reassembled without mechanical or sealing means. No longer should inflatable aquatic vessels be disposed of due to the failure of an individual component.

Preferred embodiments and variants have been suggested for this invention. Other modifications may be made, as by adding, combining, deleting, or subdividing compositions, parts, or steps, while retaining all or some of the advantages and benefits of the present invention—which itself is defined in the following claims.

We claim:

1. An inflatable aquatic vessel comprising:

a hull means, said hull means comprising a plurality of hull components, said hull components each having first and second edges, said first edge of each hull component being sealed to a second edge of an adjacent hull component, said hull components further having first and second free ends, said first and second free ends each having a row of apertures formed therein, said row of apertures of said first free ends being aligned with said rows of apertures of said second free ends so as to form a series of pairs of said apertures, a plurality of flexible connectors, each of said flexible connectors having a first and a second enlarged end, said first and second enlarged ends each having an opening formed therein, said first enlarged end of one of said connectors being inserted through one of said pairs of apertures of said series so as to form a first alignment of openings of said first enlarged ends of said connectors and a second alignment of openings of said second enlarged ends of said connectors, at least two line means, one of said line means being inserted through said openings of said first alignment, and a second one of said line means being inserted through the openings of said second alignment;

an inflatable bladder, said inflatable bladder being held within said hull means by said connectors and said line means so as to form with said hull means said aquatic vessel.

2. A method of forming an inflatable hull for an aquatic vessel, said method comprising:

providing a first hull component, said first hull component having a first edge, said first edge having a plurality of apertures formed therein;

providing a second hull component, said second hull component having a second edge, said second edge having a plurality of apertures formed therein;

providing a lower sealing die, said lower sealing die having a line of registration pins spaced to receive said apertures of said first and second edges;

placing said first hull component upon said lower die with said pins receiving said apertures of said first edge;

placing said second component upon said lower die with said pins receiving said apertures of said second edge, and wherein said first and second edges overlap;

providing an upper sealing die; and sealing said first and said second edges together with said upper and said lower dies.

* * * * *